US005456179A

United States Patent [19]

Lamelot

[11] Patent Number: 5,456,179

[45] Date of Patent: Oct. 10, 1995

[54] INFRARED PROXIMITY DETECTOR DEVICE FOR FLYING MISSILE AND DETECTOR ASSEMBLY FOR AUTOROTATING MISSILE INCLUDING SUCH DEVICE

[75] Inventor: Pierre L. M. Lamelot, Ville D'Avray, France

[73] Assignee: Societe Anonyme De Telecommunications, Paris, France

[21] Appl. No.: 325,356

[22] Filed: Oct. 28, 1981

[30] Foreign Application Priority Data

Nov. 7, 1980 [FR] France ..... 80 23819

[51] Int. Cl.[6] ..... F42C 13/02

[52] U.S. Cl. ..... 102/213; 244/3.16

[58] Field of Search ..... 102/213; 244/3.16

[56] References Cited

U.S. PATENT DOCUMENTS 4,269,121 5/1981 Sochard ..... 102/213

*Primary Examiner*—Charles T. Jordan
*Assistant Examiner*—Christopher Keith Montgomery
*Attorney, Agent, or Firm*—Stevens, Davis, Miller & Mosher

[57] ABSTRACT

A proximity detector device comprises a lens placed at the front of the missile, two circular infrared detectors of different radii centered on the optical axis of the lens and disposed in its focal plane. An electronic circuit is connected to the detectors for delivering a proximity signal when the time slot separating two pulses emitted by the two detectors is less than a predetermined threshold. The explosion of the missile is controlled by the proximity pulse.

2 Claims, 2 Drawing Sheets

INFRARED PROXIMITY DETECTOR DEVICE FOR FLYING MISSILE AND DETECTOR ASSEMBLY FOR AUTOROTATING MISSILE INCLUDING SUCH DEVICE

The present invention relates to a proximity detector for flying missile, sensitive to the infrared radiation emitted by a target and adapted to control the explosion of the missile when the latter arrives in the vicinity of the target.

The proximity detector device according to the invention is characterised in that it comprises a lens placed at the front of the missile, two circular infrared detectors of different radii centred on the optical axis of the lens and disposed in its focal plane, and an electronic circuit connected to the outputs of the detectors and delivering a proximity signal when the time slot separating two pulses emitted respectively by the two detectors is less than a predetermined threshold. Each of the circular detectors receives the radiation emanating from a generally conical portion of field. The passage, in this portion of field, of an object emitting a radiation corresponding to the spectral band of the detector provokes the emission of a pulse. It is clear that a slight time shift between the pulses emitted by the two detectors means that the object is near the missile, as long as the fields of the detectors have suitable angles of aperture.

Due to the symmetry of revolution of the detectors, the device according to the invention is particularly suitable in the case of missiles rotating about their axis, such as shells, which axis merges with the optical axis.

In the case of an autorotating missile, the central zone defined by the detector of smaller radius may advantageously be used and an angular deviation detector device serving to guide the missile, of which the spectral band also corresponds to the transmission band of the lens, may be placed therein. The angular deviation detector device will be designed so that the rotating movement of the missile about its axis is used as field scanning movement.

The invention will be more readily understood on reading the following description with reference to the accompanying drawings, in which.

Figure 1:
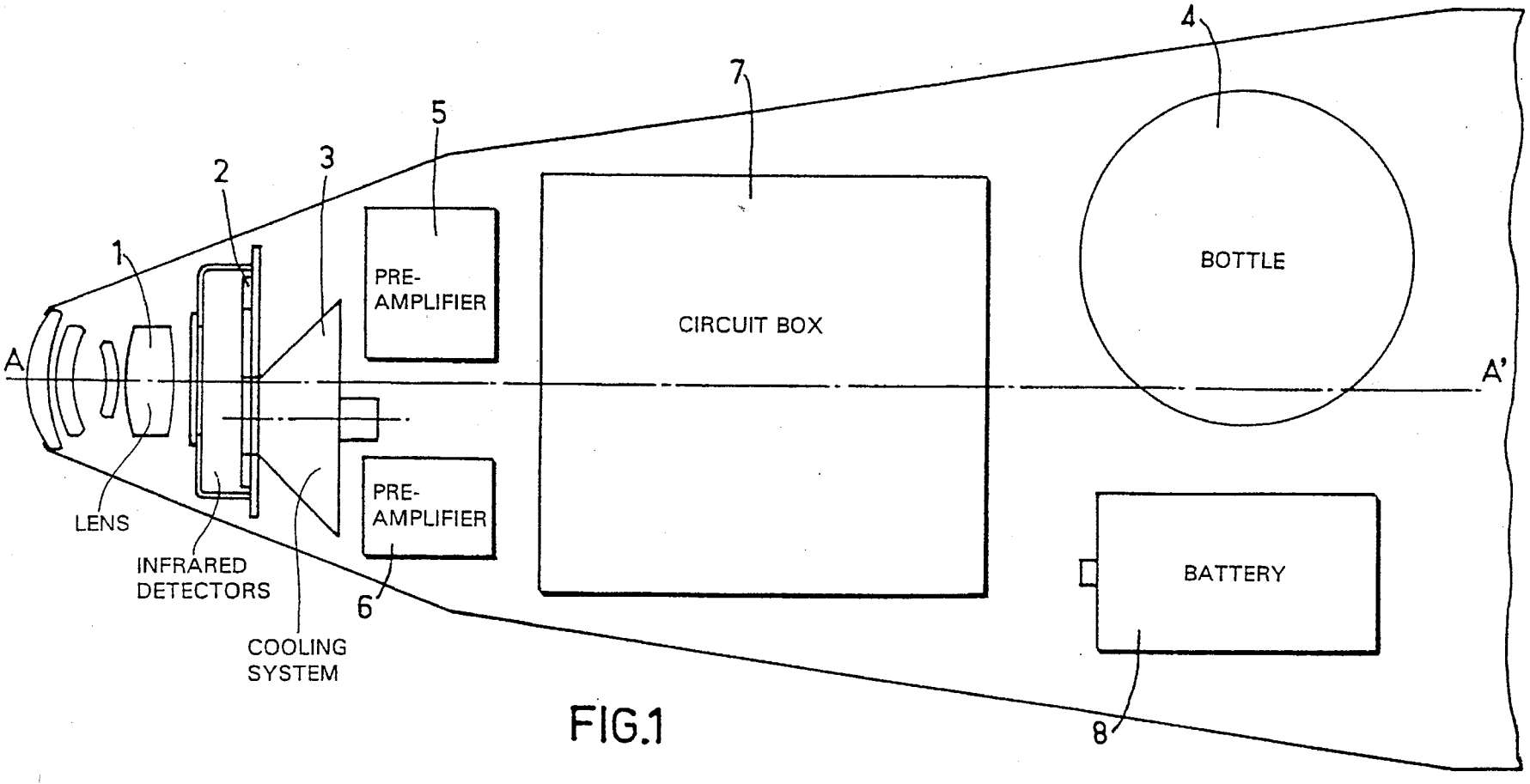
FIG. 1 is a schematic view of the head of a shell.

Referring now to the drawings, FIG. 1 shows the head of a shell of which the auto-rotation axis A–A' is shown in dashed and dotted lines. A lens 1 is placed at the front of the head, whose optical axis merges with the axis of rotation A–A'.

In the focal plane of the lens 1 is disposed an assembly of infrared detectors 2 described in greater detail hereinafter. The angular deviation detectors, to which reference will be made hereinafter, are cooled by a cooling device 3 using liquid nitrogen contained in a bottle 4.

Blocks 5,6 denote pre-amplifier boxes connected to the detectors, block 7 denotes a box containing different processing circuits elaborating the desired information from the output signals from the detectors pre-amplified at 5,6 and reference 8 denotes a battery for electrical supply of the different components.

Figure 2:
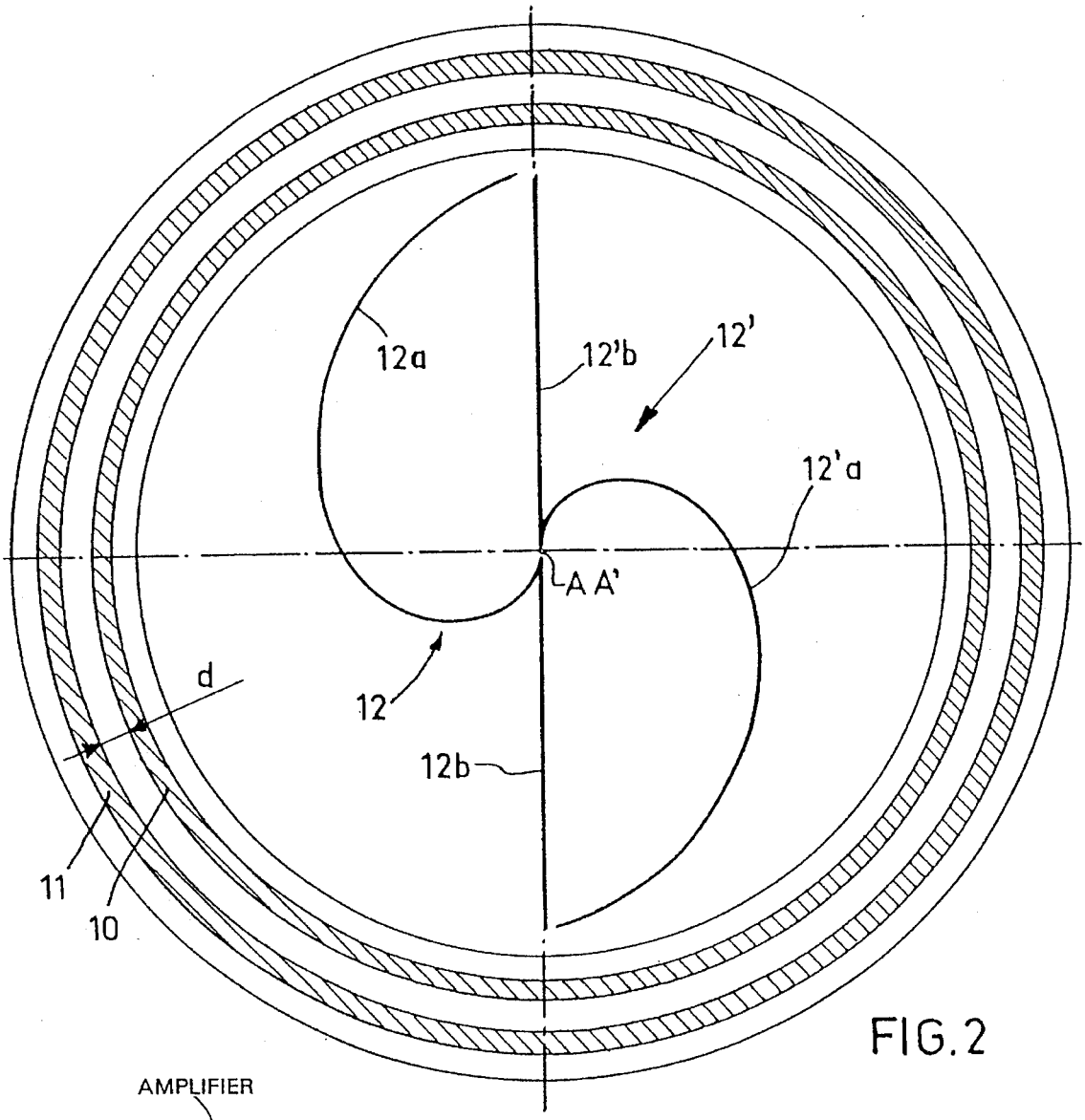
FIG. 2 is a view, to a larger scale, of the infrared detectors.

FIG. 2 shows, to a larger scale, the detector assembly which comprises, on the one hand, proximity detectors 10, 11 and, on the other hand, angular deviation detectors 12,12' serving to guide the shell towards its target.

The proximity detectors are two circular, concentric infrared detectors 10,11, centred on the optical axis A–A' and which are separated by a distance d small with respect to the radii of the detectors.

The detectors 10,11 receive the radiations emitted in conical fields. The mean vertex angle of the cone of field for the inner detector 10 is appropriately about 35°, and about 40° for the outer detector 11.

The detectors 10,11 are appropriately sensitive in a spectral band of 2.6 to 3 μm corresponding to the thermal emission of engine gases. Detectors made of PbS may be used to this end.

The circuit for producing a proximity signal from the signals emitted by the detectors 10,11 will be described hereinafter with reference to FIG. 3.

In the central zone located inside the detector 10 are provided two filiform angular deviation detectors 12, 12' symmetrical with respect to the axis of rotation A–A' of the missile and each comprising a section of Archimedes' spiral 12*a*, 12'*a* of which the pole is located on the axis of rotation A–A', and which is extended, from this pole, by a half line 12*b*, 12'*b*. It is clear that these two detectors may be replaced by at least one detector formed by two sections of curves of equations $\rho=f(\theta)$ and $\rho=f'(\theta)$, respectively, $f(\theta)$ and $f'(\theta)$ being monotonic functions, or more generally, by a detector designed to be intersected at least twice by circles centred on the axis of rotation of the missile.

Due to the autorotating movement of the shell, everything occurs as if the image of the target in the focal plane rotated about the optical axis A–A', at the auto-rotation velocity $\omega$, describing a circle. Whenever the image of the target falls on one of the sections of angular deviation detector, a signal is emitted. The time slot separating the emission of two successive signals is a function of the radius of the circle, therefore of the deviation $\alpha$ between the optical axis A–A' and the direction of the straight line connecting the shell to the target. It is thus possible to determine the deviation $\alpha$ or its derivative as a function of time $d\alpha/dt$ with the aid of appropriate circuits which do not form part of the present Application and which must be adapted to the curves chosen for the detectors.

The angular deviation detectors 12,12' preferably have a spectral band of 3–5 μm, which merges with an atmospheric window. Detectors made of InSb are preferably used.

Taking into account the spectral bands of the proximity detectors on the one hand and the angular deviation detectors on the other hand, the lens 1 must have a transmission band ranging from 2.6 to 5 μm. This does not present particular difficulties. Silicon combined with germanium is used as material for the lens 1.

Figure 3:
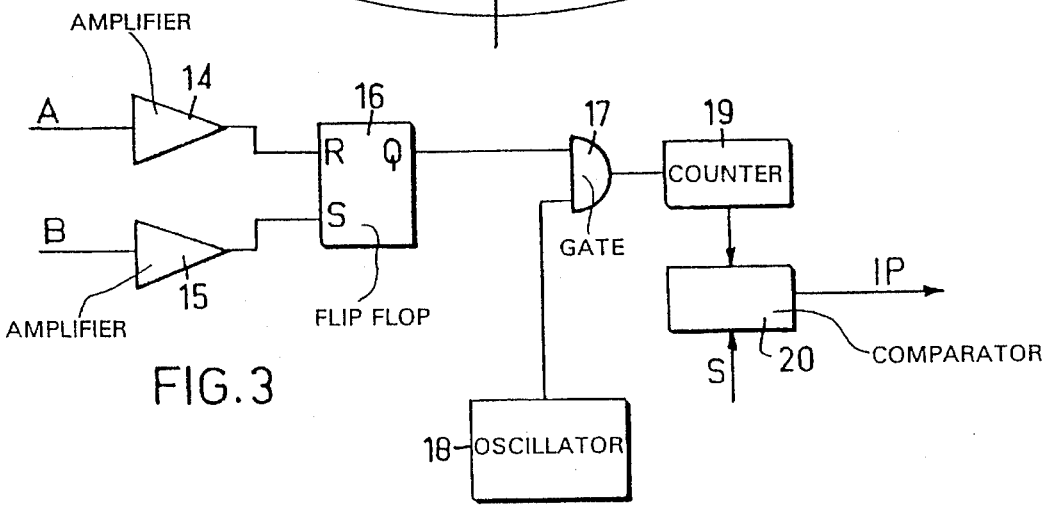
FIG. 3 is the diagram of the circuit connected to the proximity detectors.

FIG. 3 shows the circuit for generating the proximity pulse. The principle consists in measuring the time deviation between the pulses furnished by the two detectors 10, 11 and in comparing it with a given threshold, a pulse being produced if the deviation is less than the threshold.

To this end, the pre-amplified output signals A and B from the detectors 10, 11, after passing in amplifiers 14, 15, are applied to a flip flop 16 whose output Q permits an AND gate 17 connected on the other hand to an oscillator 18. The output of the gate 17 is applied to a counter 19 of which the contents, representing the deviation between the pulses, is compared in a comparator 20 with a predetermined threshold S. A proximity pulse IP is emitted by the comparator 20 if the deviation between the pulses is less than the threshold. This proximity pulse controls, in known manner, the explosion of the shell via a detonator.

What is claimed is:

1. Proximity detector device for a flying missile aimed at a target, sensitive to the infrared radiation emitted by the target, characterized in that it comprises a lens placed at the front of the missile, two circular infrared detectors of different radii centred on the optical axis of the lens and disposed in its focal plane, and an electronic circuit connected to the outputs of the detectors and delivering a proximity signal when the time slot separating two pulses emitted respectively by the two detectors is less than a predetermined threshold.

2. Detector assembly for missile flying in autorotation, characterized in that it comprises the proximity detector device of claim 1 and an angular deviation detector device comprising at least one infrared detector placed in the central zone defined by the proximity detector of smaller radius, and designed to be intersected at least twice by circles centred on the axis of rotation of the missile.

* * * * *